US006260950B1

(12) United States Patent
Tanno et al.

(10) Patent No.: US 6,260,950 B1
(45) **Date of Patent: *Jul. 17, 2001**

(54) INK JET PRINTING SYSTEM USING PRINTERS WITH INTERCHANGEABLE PRINTING UNITS

(75) Inventors: Koichi Tanno, Kawasaki; Tetsuo Suzuki, Yokohama; Haruyuki Yanagi, Machida; Hiroyuki Kinoshita, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/634,249

(22) Filed: Apr. 18, 1996

(30) Foreign Application Priority Data

Apr. 21, 1995 (JP) ..... 7-097190
Aug. 11, 1995 (JP) ..... 7-206133

(51) Int. Cl.[7] ..... B41J 2/24
(52) U.S. Cl. ..... 347/49
(58) Field of Search ..... 347/49, 20, 43, 347/86, 87

(56) References Cited

U.S. PATENT DOCUMENTS 4,703,332 10/1987 Crotti et al. ..... 347/87
5,461,405 10/1995 Lehmann et al. ..... 347/49
5,504,506 * 4/1996 Noaki ..... 347/16
5,506,611 * 4/1996 Ujita et al. ..... 347/86
5,512,926 4/1996 Uchikata et al. .

FOREIGN PATENT DOCUMENTS 0 058 092 8/1982 (EP) .
0 195 949 10/1986 (EP) .
0 313 205 4/1989 (EP) .
60-192640 10/1985 (JP) .
4-133746 * 5/1992 (JP) .
WO 91/06432 5/1991 (WO) .

* cited by examiner

*Primary Examiner*—N. Le
*Assistant Examiner*—Anh T. N. Vo
(74) *Attorney, Agent, or Firm*—Fitzpatrick, Cella, Harper & Scinto

(57) ABSTRACT

An ink jet printing member mounted on a scanning carriage to discharge ink for recording while traveling with the carriage includes an extrusion that engages with a hook of the scanning carriage when this member is mounted on the carriage. This extrusion is arranged to dually function to identify the kind of the mounted ink jet printing member in accordance with the location of the extrusion and to secure the printing member on the carriage. With this arrangement, the structure is simplified to reduce the manufacturing costs significantly, while preventing the user from erroneously mounting an ink jet recording member on the carriage for an intended recording.

81 Claims, 14 Drawing Sheets

1
2
20
21
23
28
82
8
83
84
81
30
58
37
36
50
5
41
41a
41
61
6
60
62
A

INK JET PRINTING SYSTEM USING PRINTERS WITH INTERCHANGEABLE PRINTING UNITS

BACKGROUND OF THE INVENTION

1. Field of the invention

The present invention relates to a printing unit supply system for supplying the printing members (an ink tank, a head tank or a head) that are used in accordance with the newly enhanced functions of a printing apparatus to meet the marketing environment of printing apparatuses.

More particularly, the invention relates to an ink jet printing apparatus having an exchangeable or detachably mountable ink tank, ink jet head, ink jet head integrally formed with an ink tank, or the like mounted on the apparatus for its use. The invention further relates to the additional provision of an effective structure practically applicable to the printing apparatus when exchanging or detachably mounting the ink jet printing members on the apparatus.

2. Related Background Art

For an ink jet printing system adoptable as the typical printing unit supply system, the ink jet printing apparatuses are on the main current. It is arranged for them to mount on its traveling type carriage exchangeable or detachably mountable ink jet printing members, such as an ink tank, an ink jet head, or an ink jet head integrally formed with an ink tank.

Many ink jet printing apparatuses have been materialized with the provisions of functions to meet various demands. As a result, the amount of stored ink, kinds of ink, and the structures of discharge ports for discharging ink should be made different in accordance with the functions required for those different ink jet printing apparatuses.

In this respect, there has been a mode in which heads, formed integrally with the respective ink tanks serving as plural ink jet printing members, are exchangeably used for one ink jet printing apparatus. In this case, it is possible to use them economically by selecting an ink jet printing member in accordance with a printing mode to be applied. For example, if monochromatic recording is made by use of a color recording ink jet printing member, an erroneous recording may be brought about or only ink for monochromatic recording is consumed, leading to an extremely uneconomical operation eventually. For the execution of a monochromatic recording, an effective printing is possible just by using an ink jet recording member retaining ink only for monochromatic recording. Any erroneous mounting of a member for different use may invite an improper operation.

An erroneous mounting of the kind has been detected for correction by the application of electrical identification. As a result, it takes time before the operator is informed of such erroneous mounting. This delay presents a drawback in carrying out the intended operation efficiently.

In order to control such mounting as described above, it has been tried to provide an additional structure. For example, there is arranged a mounting structure that can be shared by a color ink tank and a monochromatic ink tank so as to enable them to be mounted on a carriage as required. In addition to this sharable structure, extrusions are also provided for ink tanks, while escapes are arranged in specific locations on the carriage where the ink tanks are mounted in order to receive such extrusions of the ink tanks, among other controlling measures.

In such case as described above, it is required for a printing apparatus, having a new function additionally provided, to be able to mount any one of new and old ink jet printing members on the apparatus. For example, the one to be used for color printing should of course be capable of mounting a new ink jet printing member for color printing use, but this apparatus is also required to be usable for the conventional ink jet printing member for use of the monochromatic recording. On the contrary, however, the printing apparatus of the conventional type cannot use the new ink jet printing member or it is unnecessary for such apparatus to be provided with any of the new ink jet printing members. (For example, the ink jet printing member for color recording cannot be used for the ink jet printing apparatus for use of the monochromatic recording described above.) Therefore, in order to avoid any confusion on the operator's part, there is a need for the provision of a structure that disables any one of the new ink jet printing members to be mounted on such conventional apparatus.

There are also problems being encountered in the provision of the ink jet printing members themselves. Such problems are mainly caused by the way of mounting them on the apparatus. When a plurality of ink jet printing members should be mounted on the specific kind of the apparatus, the designing and manufacture of such members are complicated and different from each other for each kind of apparatus, thus resulting in higher manufacturing costs, although there is no problem in effecting its mounting and making identification between the members, because individual designing of each member is possible for every kind of the apparatus.

Also, for the implementation of cost reduction, it may be possible to unify the ink jet printing members, but in this case, too, the provision of additional extrusions and escapes to receive such extrusions should be provided in order to enable them to be identified between them distinctly. Therefore, a problem is still encountered that the manufacturing costs become higher to the extent that such additional components should be provided for attaining the purpose.

SUMMARY OF THE INVENTION

The present invention is designed in consideration of the various aspects of the mounting capability of the members that constitute an ink jet printing apparatus described above. It is an object of the invention to provide a printing unit supply system, ink jet printing members used therefor, and an ink jet printing apparatus using such system and members, which is capable of performing the exchanging and mounting operations of ink jet members reliably, and effectively utilizing different ink jet printing members by the application of simple structural changes.

It is another object of the invention to provide a printing unit supply system, ink jet printing members used therefor, and an ink jet printing apparatus using such system and members, which is capable of operating the mounting of the ink jet printing members, and also, capable of confirming the kinds of the mounted members simultaneously.

It is still another object of the invention to provide a printing unit supply system, ink jet printing members used therefor, and an ink jet printing apparatus using such system and members, wherein the durability and reliability of the printing unit supply system are further enhanced, in addition to the achievement of the objectives described above, in consideration of any possible degradation of reliability and advancing looseness of the mechanism as the replacement frequency of the printing members is increased.

It is a further object of the invention to provide an ink jet recording member to be mounted on a scanning type carriage to discharge ink for recording while traveling by means of the carriage. This member includes the extrusion that engages with a hook constituting the scanning carriage when the member is mounted on the carriage, this extrusion being arranged to dually function as identifying means for indicating the kind of the ink jet printing member in accordance with the location of the extrusion thus arranged.

It is still a further object of the invention to provide a printing unit supply system that uses an ink jet recording member to be mounted on a scanning type carriage to discharge ink for recording while traveling by means of the carriage, wherein the hook of the scanning type carriage is in a configuration that enables the hook to engage with any one of the extrusions arranged in the different positions of the different kinds of ink jet printing members.

It is an object of the invention to provide a printing unit supply system for supplying a second printing member complying with the functions of a second printer added more than those of a first printer with respect to the marketing environment necessitating the provision of a first printing member provided with a first engaging part to engage with the first printer and the first positioning mechanism of the first printer, this printing unit supply system including the following:

a second engaging part arranged for the second printing member, corresponding to the first engaging part of the first printing member, this second engaging part being arranged in a location so as not to allow such part to engage with the first positioning mechanism.

It is still another object of the invention to provide a printing unit supply system for supplying a second printer capable of individually using a first printing member and a second printing member different from the first printing member with respect to the marketing environment necessitating the provision of the first printing member provided with a first engaging part to engage with the first printer and the first positioning mechanism of the first printer, this printing unit supply system including the following:

a second positioning mechanism arranged on the second printer, being provided with a hooking unit having a width larger than that of the hooking unit of the first positioning mechanism, the wider hooking unit being arranged to engage in a location different from the engaging parts of the first and second printing members.

It is a further object of the invention to provide an ink jet printing apparatus for supplying a second printing member complying with the functions of a second printer added more than those of a first printer with respect to the marketing environment necessitating the provision of a first printing member provided with a first engaging part to engage with the first printer and the first positioning mechanism of the first printer, this ink jet recording apparatus including the following:

a second engaging part arranged for the second printing member, corresponding to the first engaging part of the first printing member, this second engaging part being arranged in a location so as not to allow such part to engage with the first positioning mechanism.

It is still a further object of the invention to provide an ink jet printing apparatus for supplying a second printer capable of individually using a first printing member and a second printing member different from the first printing member with respect to the marketing environment necessitating the provision of the first printing member provided with a first engaging part to engage with the first printer and the first positioning mechanism of the first printer, this ink jet recording apparatus including the following:

a second positioning mechanism arranged on the second printer, being provided with a hooking unit having a width larger than that of the hooking unit of the first positioning mechanism, the wider hooking unit being arranged to engage in a location different from the engaging parts of the first and second printing members.

DETAILED DESCRIPTION OF THE PREFERRED EMBODIMENTS

Hereinafter, with reference to the accompanying drawings, the description will be made of the embodiments in accordance with the present invention.

Figure 1:
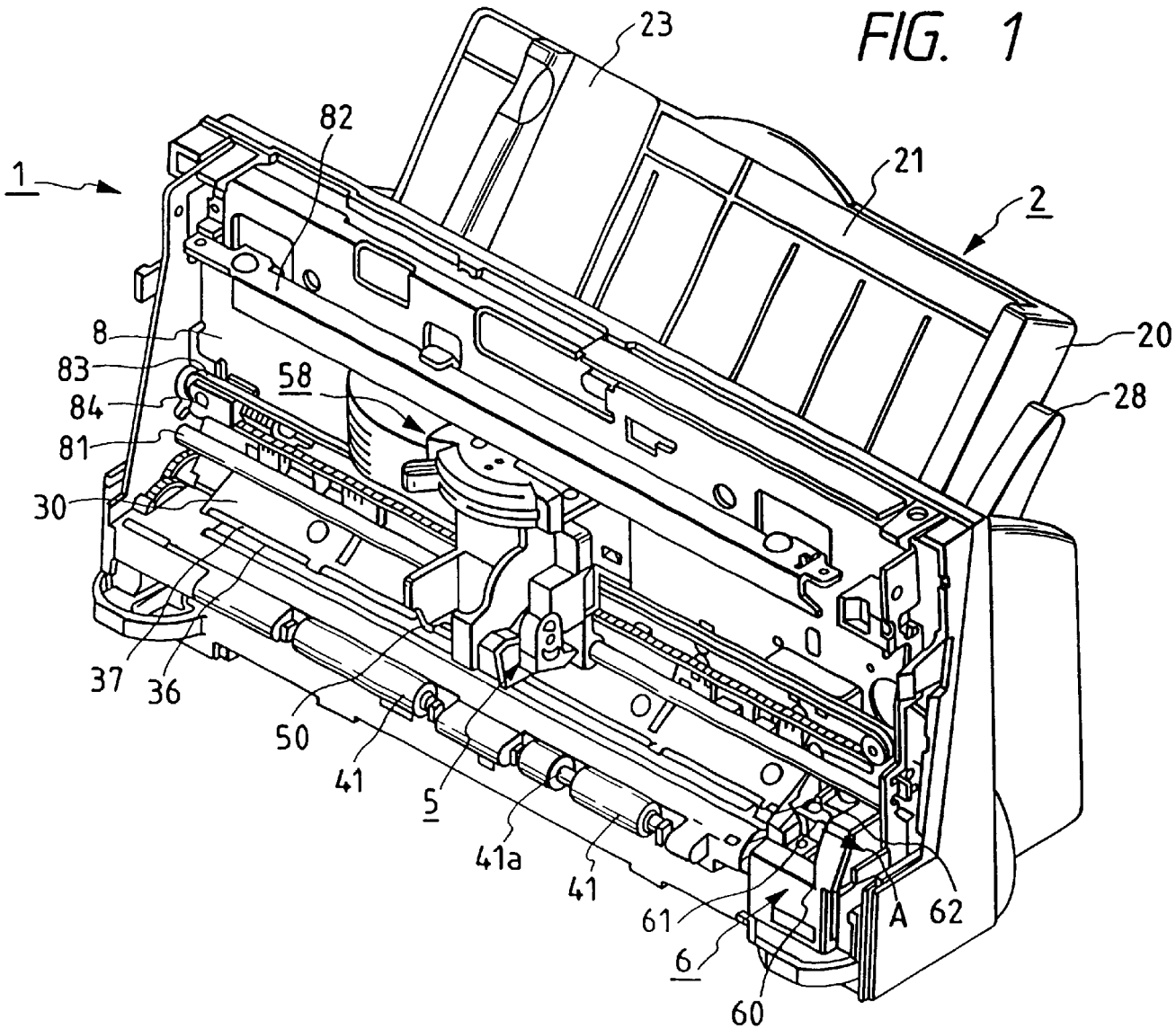
FIG. 1 is a perspective view which shows one example of the entire structure of a printing apparatus as an embodiment in accordance with the present invention.
Figure 2:
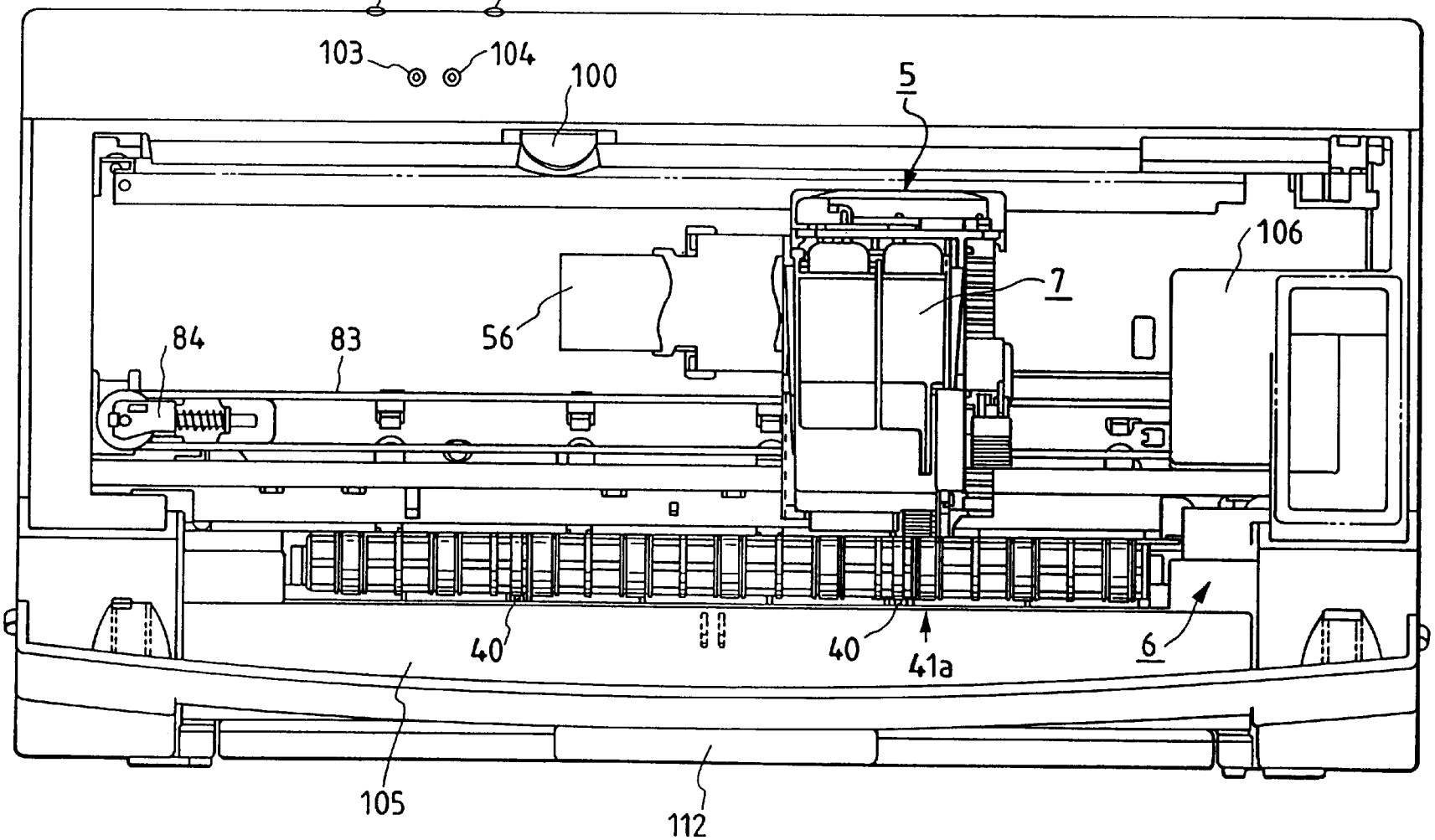
FIG. 2 is a front view which shows the printing apparatus as an embodiment in accordance with the present invention.
Figure 3:
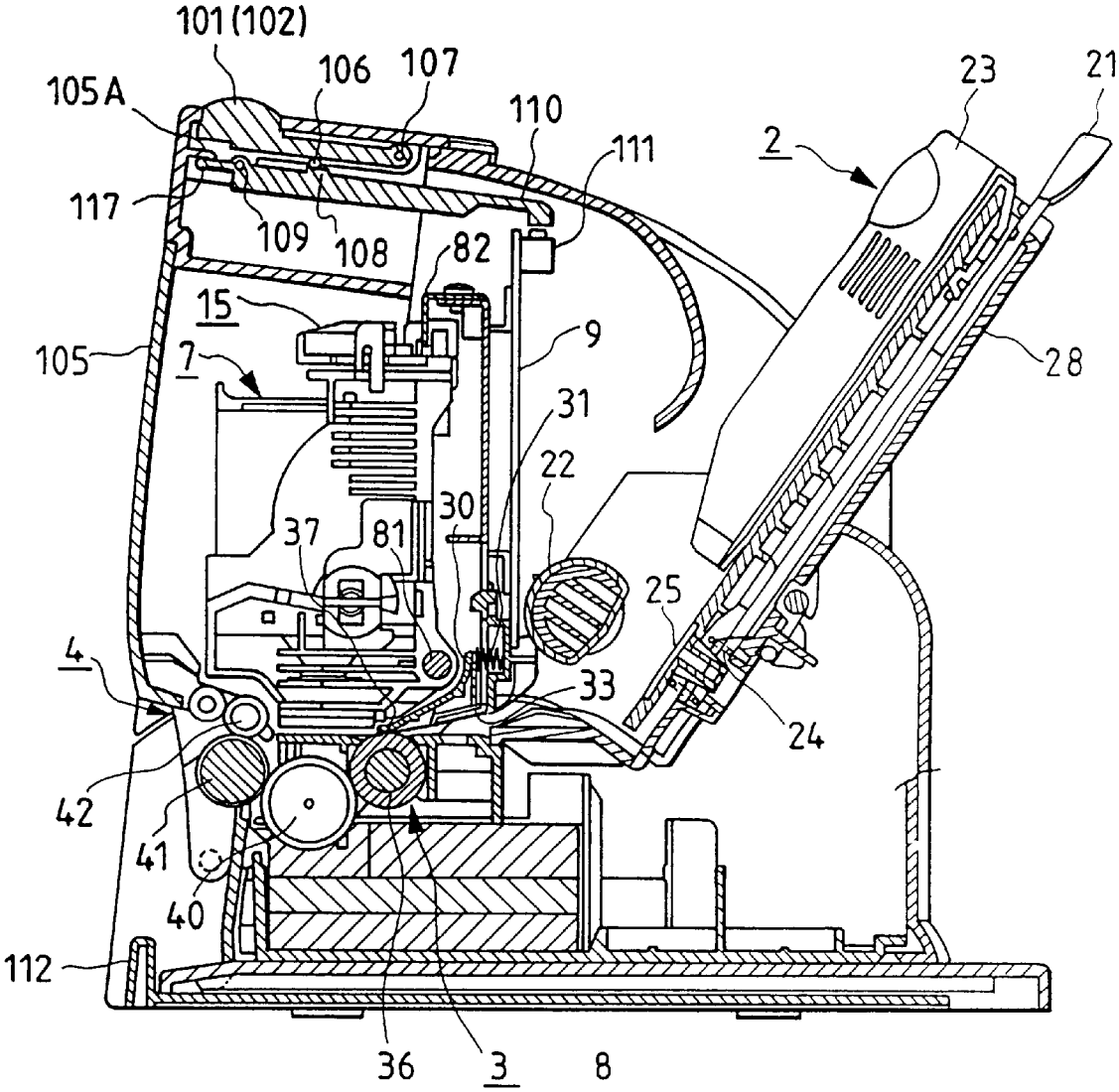
FIG. 3 is a side sectional view which shows the printing apparatus as an embodiment in accordance with the present invention.

At first, in conjunction with FIG. 1 to FIG. 3, the outline of a printing apparatus will be described in accordance with an embodiment of the present invention. FIG. 1 is a perspective view showing the entire structure of a printing apparatus 1. FIG. 2 is a front view showing the printing apparatus 1. FIG. 3 is a side sectional view showing the printing apparatus 1.

The printing apparatus 1 provided with an automatic sheet feeder comprises a sheet feeding unit 2, sheet carrying unit 3, sheet exhausting unit 4, carriage unit 5, and cleaning unit 6. Here, these units will be divided into each item, and will be described briefly item by item.

(A) Sheet Feeding Unit

The sheet feeding unit 2 is structured to be able to install a pressure plate 21 to stack recording sheets P on it, and a sheet feeding rotary element 22 on a base 20. On the pressure plate 21, a movable side guide 23 is movably installed to regulate the stacking position of the recording sheets P. The pressure board 21 can rotate around a shaft connected with the base 20, and is biased to the sheet feeding rotary element 22 by means of a pressure plate spring 24. On a part of the pressure plate 21 facing the sheet feeding rotary element 22, a separation pad 25 formed by an artificial leather or some other material having a large friction coefficient is installed in order to prevent a recording sheet from being overlapped with the other ones in feeding each of the sheets thus stacked. Further, on the base 20, there are provided a separation nail (not shown) to separate the recording sheets P one by one while covering the corner of the recording sheets P in one direction; a banked portion (not shown) integrally formed on the base 20 in order to separate thick papers or the like for which the separation nail cannot be used; a switching lever 28 for causing the separation nail to be actuated in a position for an ordinary paper sheet and disabling it to be operative in a position for a thick paper sheet; and a releasing cam to release the engagement of the pressure plate 21 and the sheet feeding rotary element 22.

With the structure described above, the releasing cam depresses the pressure plate 21 to a given position on standby. Thus, the contact between the pressure plate 21 and the sheet feeding rotary element 22 is released. Then, in this state, when the driving force of a carrier roller 36 is transmitted to the sheet feeding rotary element 22 and releasing cam through gears and others, the releasing cam is caused to part from the pressure plate 21. The pressure plate 21 ascends to enable the sheet feeding rotary element 22 to abut upon a recording sheet P. Along the rotation of the sheet feeding rotary element 22, the recording sheet P is picked up, thus the sheet feeding being started. Then, the sheets are separated one by one by means of the separation nail, and fed into the sheet carrying unit 3. The sheet feeding rotary element 22 and releasing cam rotate until the recording sheet P is transferred to the sheet carrying unit 3, and then, stay on standby again, thus releasing the contact between the recording sheet P and the sheet feeding rotary element 22. The driving force from the carrier roller 36 is cut off.

(B) Sheet Carrying Unit

The sheet carrying unit 3 comprises the carrier roller 36 to carry a recording sheet P, and a PE sensor (not shown). With the carrier roller 36, a pinch roller 37 is in contact to rotate following the rotation of the carrier roller. The pinch roller 37 is supported by a pinch roller guide 30, and biased by means of a pinch roller spring 31. Thus the pinch roller 37 is pressed to the carrier roller 36 to generate a force to carry the recording sheet P. Further, at the entrance of the sheet carrying unit 3, which the recording sheet P is fed to enter, an upper guide 33 and a platen (not shown) are arranged to guide the recording sheet P. For the upper guide 33, a PE sensor lever (not shown) is arranged to transmit the detection of the leading end and the trailing end of the recording sheet P to the PE sensor. Further, on the downstream side of the carrier roller 36 in the recording sheet carrying direction, a head cartridge 7 is provided for the formation of images in accordance with image information.

With the structure described above, the recording sheet P, which has been transferred to the sheet carrying unit 3, is guided by means of the platen, pinch roller guide 30, and upper guide 33 to be carried to a roller pair of the carrier roller 36 and pinch roller 37. At this juncture, the PE sensor lever detects the leading end of the recording sheet P that has been carried, hence obtaining the printing position of the recording sheet P. Also, the recording sheet P is carried on the platen by the rotation of the roller pair 36 and 37 by means of an LF motor (not shown).

Figure 4:
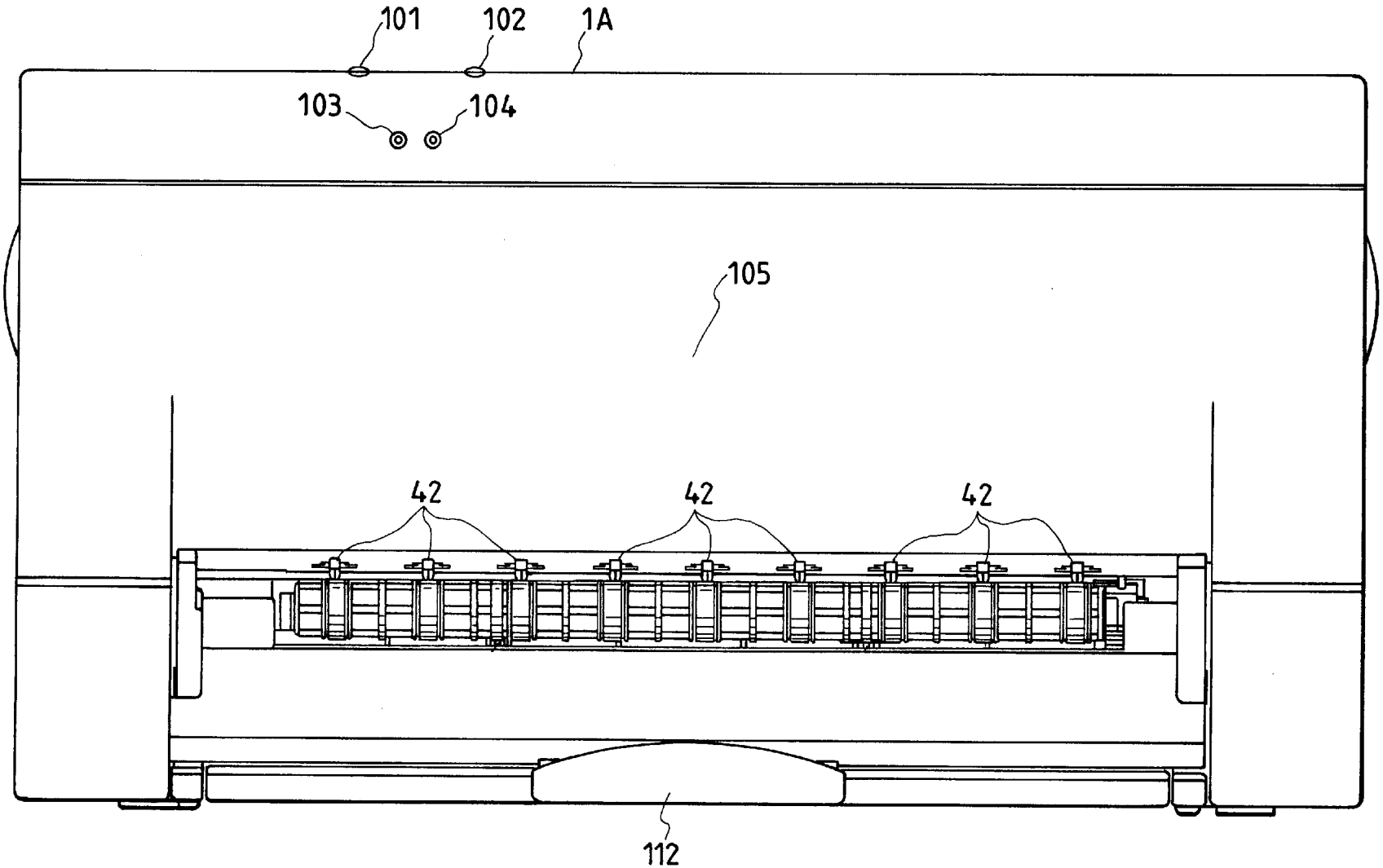
FIG. 4 is a front view which shows the printing apparatus as an embodiment in accordance with the present invention.

Here, for the head cartridge 7, an easily exchangeable ink jet recording head, which is formed integrally with an ink tank, is used. This recording head is made capable of giving heat to ink by means of heater and others formed by electrothermal transducing elements. Then, film boiling is created in ink by the heat thus generated. The film boiling causes the development and contraction of an air bubble to generate pressure changes whereby, as shown in FIG. 4, ink is discharged from the nozzle of the recording head for the formation of images on the recording sheet P.

(C) Carriage Unit

The carriage unit 15 is provided with a carriage 50 for mounting a head cartridge 7 on it. The carriage 50 is supported by a guide shaft 81 for enabling the carriage to perform reciprocating scans in the direction at right angles to the carrying direction of a recording sheet P, and by a guide rail 82 that maintains a gap between the head cartridge 7 and recording sheet P by holding the upper rear end of the carriage 50. In this respect, the guide shaft and the guide rail 82 are fixed to a chassis 8. Also, the carriage 50 is driven by means of a carriage motor (not shown) through a timing belt 83. The timing belt 83 is tensioned and supported by an idle pulley 84. Further, the carriage 50 is provided with a flexible base board 56, as shown in FIG. 2, for transmitting head signals from an electric base board 9 to the head cartridge 7.

With the structure described above, when images are formed on a recording sheet P, the roller pair 36 and 37 carry the recording sheet P to the line position where the images are formed (a position in the carrying direction of the recording sheet P). At the same time, the carriage 50 is driven by means of the carriage motor to shift in the column direction of the images to be formed (the position perpendicular to the carrying direction of the recording sheet P). In this way, the head cartridge 7 is allowed to face the position where the images are formed. After that, by the application of signals from the electric base board 9, the head cartridge 7 discharges ink toward the recording sheet P to form images on it.

(D) Sheet Exhausting Unit

The sheet exhausting unit comprises a transfer roller 40 that abuts upon the carrier roller 36, and a sheet exhausting roller 41 that abuts upon the transfer roller 40. Therefore, the driving force of the carrier roller 36 is transmitted to the sheet exhausting roller 41 through the transfer roller 40.

Also, a spur 42, which can rotate following the rotation of the sheet exhausting roller, is in contact with the sheet exhausting roller. With the structure described above, the recording sheet P having the images formed by means of the carriage unit 15 is nipped and carried by the sheet exhausting roller and the spur 42, thus being exhausted onto a sheet exhaust tray 12 or the like.

(E) Cleaning Unit

The cleaning unit 6 comprises a pump 60 for use of cleaning the head cartridge 7; a cap 61 to suppress the drying of the head cartridge 7; and a driving switch over arm 62 to be used for switching over the driving force from the-carrier roller to the sheet feeding unit, as well as to the pump 60. When the driving switch over arm 62 is in the operation other than the sheet feeding and cleaning, the planet gear (not shown) that rotates around the axis of the carrier roller 36 is fixed in a given position. Therefore, no driving force is transmitted to the sheet feeding unit 2 and the pump 60. When the carriage 50 shifts, the driving switch over arm 62 moves in the direction indicated by arrow A. Then, the planet gear is released from the fixed position so as to move in accordance with the regular and reverse rotations of the carrier roller 36. When the carrier roller 36 rotates regularly, no driving force is transmitted to the sheet feeding unit 2. With the reverse rotation thereof, the driving force is transmitted to the pump 60.

Here, in conjunction with FIG. 2 to FIG. 4, the positional relationships will be described briefly.

FIG. 4 is a front view which shows an ink jet printing apparatus with its front cover 105, a member that can be opened and closed, in a closed state to cover the printing apparatus. Here, the constituents that can be recognized visually are a power-supply key 101, a resetting key 102, and LED lamps 103 and 104 for indicating the status of the respective keys, which form a first pressing unit and the external operation area. Tray 112 is shown as designating a drawer type tray to receive recording sheets after recording. The structure that can be recognized further in accordance with FIG. 4 is sheet exhausting means formed by sheet exhausting rollers that presents the exhausting area of the recording sheet. In comparison with FIG. 4, FIG. 2 is a view which shows the ink jet printing apparatus in a state that its front cover 105 is opened. In this state, a carriage 15 is exposed in the exchanging area where an ink jet printing member is detachably mounted on a carriage, and also, an operational key 100 (a second pressing unit) is exposed. This key is arranged to cause the carriage to travel from the end region of the carriage traveling area (where the carriage is covered by means of a shielding member 106 in order to essentially prohibit the removal of the ink jet printing member from the carriage) to the exchanging area where the ink jet printing member can be attached to or detached from the carriage. The operational key 100 is in a bright moss green color different from its gray and white circumferential parts, and is made larger than the operational keys 101 and 102 described above. The operational key 100 is located above the traveling area of the carriage, and positioned in a location away approximately 50 mm away from the edge portion of the carriage 15 residing in the exchanging area in FIG. 2 (it is good enough to set such position in a location approximately 30 mm away from the exchanging area in the traveling direction of the carriage). In this way, the operativity of this key is enhanced.

To summarize, this structure includes an ink jet printing apparatus provided with a scanning type carriage having an ink jet printing member mounted on it; traveling means for causing the carriage to travel at least from the end region of the carriage traveling area to the exchanging area where an ink jet printing member can be detachably mounted on the carriage; and an opening and closing member for opening and closing at least the exchanging area, wherein the traveling means cannot be operated when the opening and closing member is in the closing state, and can be manually operated by means of an operational key arranged in a position where it is operative when the opening and closing member is only in the opening state. In accordance with this structure, there is no need for the carriage to travel to the exchanging area unnecessarily. At the same time, it is made a prerequisite that the opening and closing member is in the opening state when an exchange, an attachment or detachment should be performed. Thus, it is possible to enhance the operativity of the apparatus still more.

Figure 7:
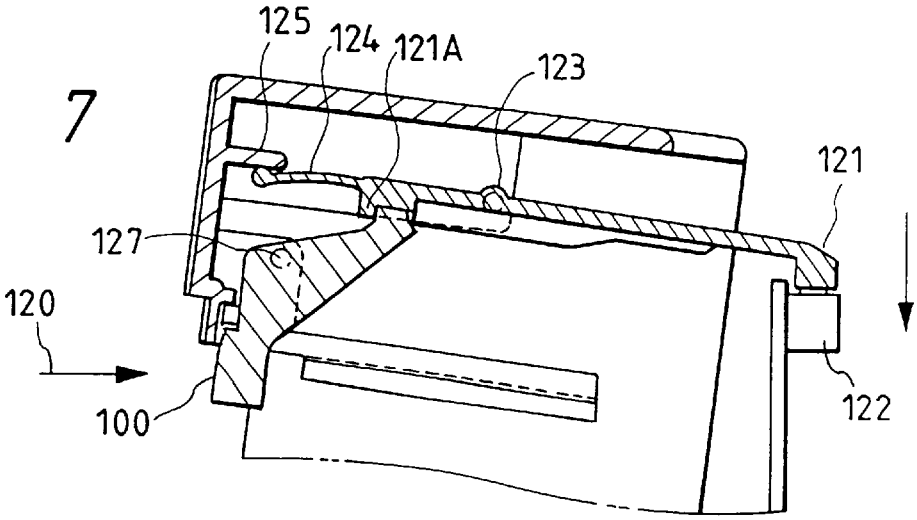
FIG. 7 is a cross-sectional view which shows the key structure of a printing apparatus in accordance with the present invention.
Figure 8A:
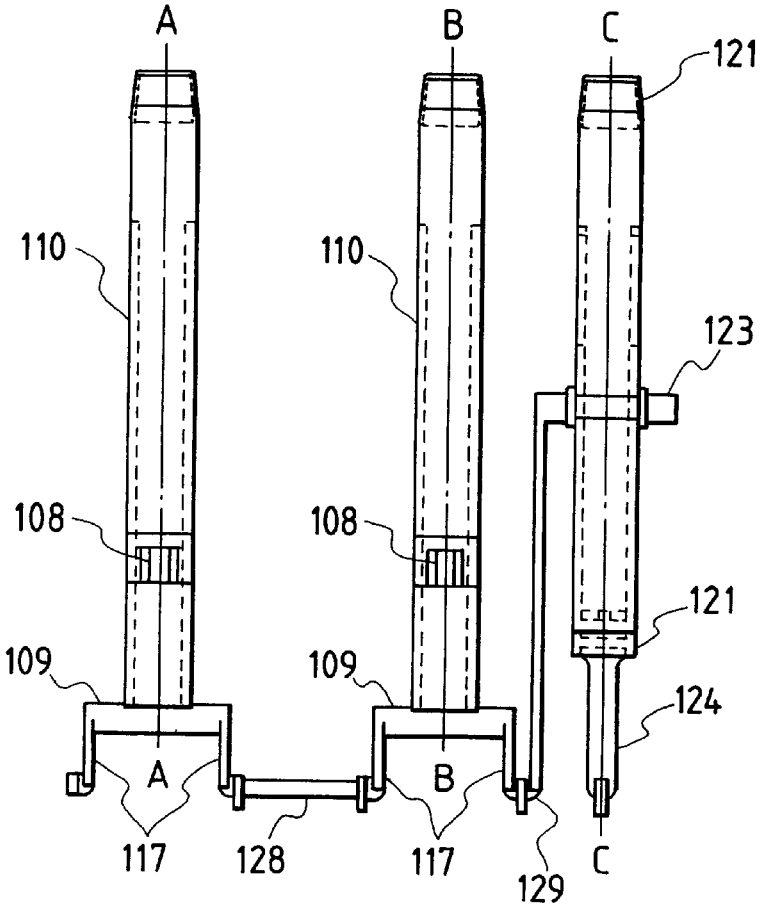
FIGS. 8A to 8C are the upper surface views showing the link mechanism of the keys of the printing apparatus in accordance with the present embodiment, respectively.

Now, in conjunction with FIG. 3, and FIG. 5 to FIG. 8C, the brief description will be made of an integrated unit (FIG. 8A). With respect to the keys 101 and 102 of the operational unit externally exposed at all times, the operational key 100 is operated in the directions (indicated by arrows 115 and 120) different from those of the exposed keys 101 and 102 of the operational unit. The levers (121 and 110), which are capable of displacing themselves when actuated by the respective operations of the key 100, as well as the exposed keys 101 and 102, are provided with elastically deformative areas (124 and 117) in the lever units themselves in order to regulate them to make it possible for them to be displaced themselves individually.

A switching mechanism described below is provided with three members shown in FIGS. 8A, 8B, and 8C, respectively, in order to depress each of the switches 111A, 111B, and 111C in the housing of the apparatus.

Figure 5:
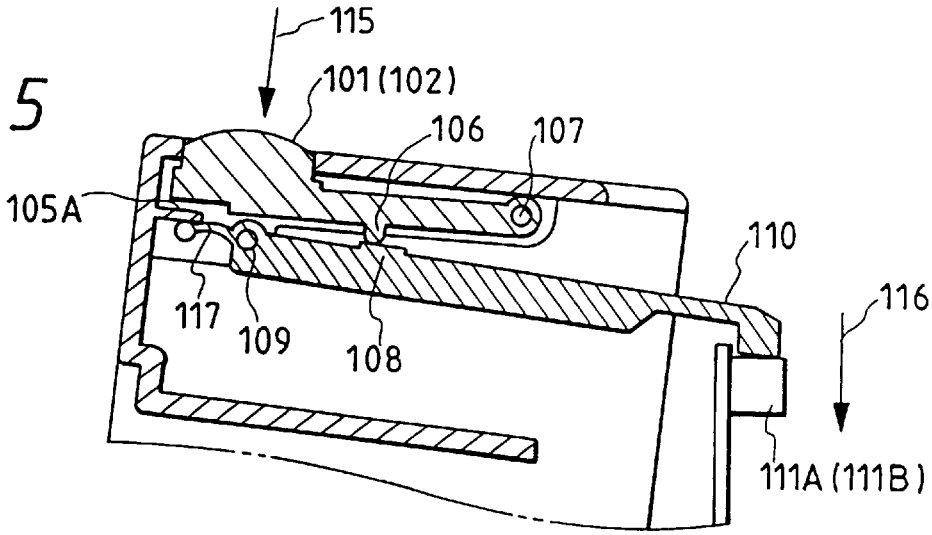
FIG. 5 is a cross-sectional view which shows the key structure of a printing apparatus in accordance with the present embodiment.

FIG. 5 is a cross-sectional view schematically showing the apparatus, taken along line A—A in FIG. 8A including the plane perpendicular to the surface of that figure. In this respect, the schematic cross-sectional view of the apparatus, taken along line B—B in FIG. 8A including the plane perpendicular to the surface thereof, is also the same as FIG. 5.

Figure 6:
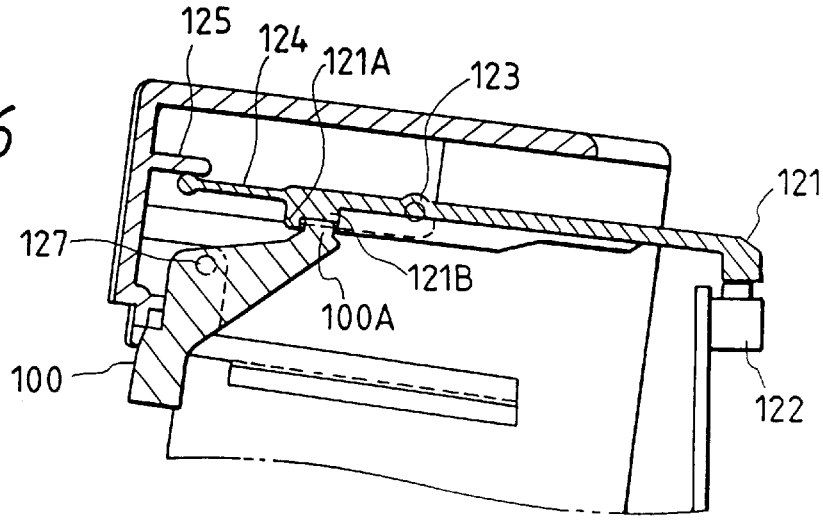
FIG. 6 is a cross-sectional view which shows the key structure of a printing apparatus in accordance with the present invention.

Also, FIG. 6 and FIG. 7 are cross-sectional views schematically showing the apparatus, taken along line C—C in FIG. 8A including the plane perpendicular to the surface thereof.

In FIG. 5, the elastically deformative area 117 of the lever 110, which is always in contact with the extrusion 105A of the printing apparatus main body, is deformed when the lever 110 rotates by means of the key 101 being pressed in the direction indicated by an arrow 115 with respect to the rotational axis 109 of the lever 110, thus pressing the switch 111(A) or switch 111(B). After that, the lever is restored to the state shown in FIG. 3 by the elastic force generated by such deformation. The switch 111 generates a signal by one operation of this lever, and transmits the signal to controlling means (not shown). The key can rotate around the rotational center 107A supported by the shaft 107 of the printing apparatus main body. Then the force is transferred from the extrusion 106 serving as a pressing portion to the receiving portion 108 of the lever 110.

In FIG. 6 and FIG. 7, the operational key 100 for use of exchanging ink jet printing members functions in such a manner that when the key 100 is pressed in the direction indicated by an arrow 120 with respect to the rotational axis of the lever, the elastically deformative area 124 of the lever 121, which is always in contact with the extrusion 125 of the printing apparatus main body, is deformed as the lever 121 rotates, and presses the switch 122. After that, the elastic force generated by such deformation enables the lever to restore to the state shown in FIGS. 12A and 12B. The switch 122 generates a signal by means of one operation of this lever, and transmits the signal to the controller (not shown). The key 100 can rotate around the rotational axis 127 supported by the shaft holder of the printing apparatus main body. Therefore, the force is transferred from the extrusion 100A to the receiving portion 121B of the lever 121. This receiving portion is provided with an extrusion 121A as a pressure receptacle, which serves dually as a stopper to prevent it from being drawn out.

Figure 8B:
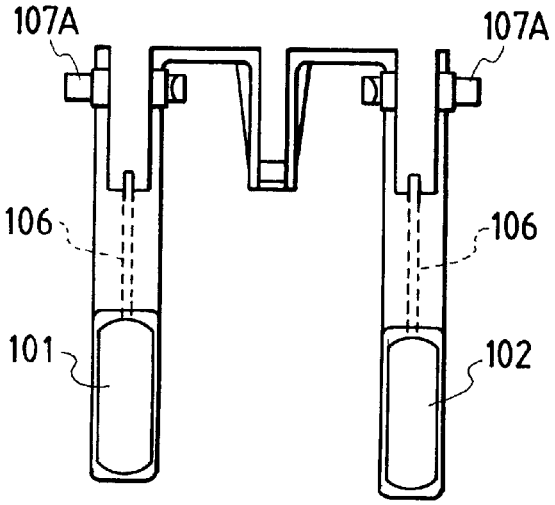
Figure 8C:
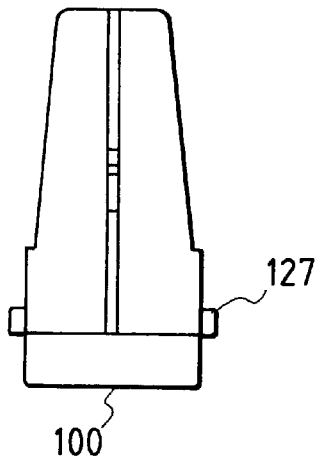

As shown in FIGS. 8A, 8B, and 8C, the lever structure is integrated with respect to each of the three switches so that the same displacement is effectuated. Therefore, the embodiment described above achieves the simplification of the structure to make the apparatus smaller.

More specifically, the mechanism that transfers the operation of the key 101 to the switch 110A and the mechanism that transfers the operation of the key 102 to the switch 110B are connected by means of a coupler 128. With this arrangement, and the mechanism that transfers the operation of the key 100 to the switch 122 are connected by a coupler 129. Each of the mechanisms including each coupler is structured so as not to allow each of the key operations to be transferred to the adjacent mechanism. As a result, there is no possibility that any malfunction takes place due to the transfer of a key operation to a switch other than a specific one for which such transfer is intended.

Figure 9:
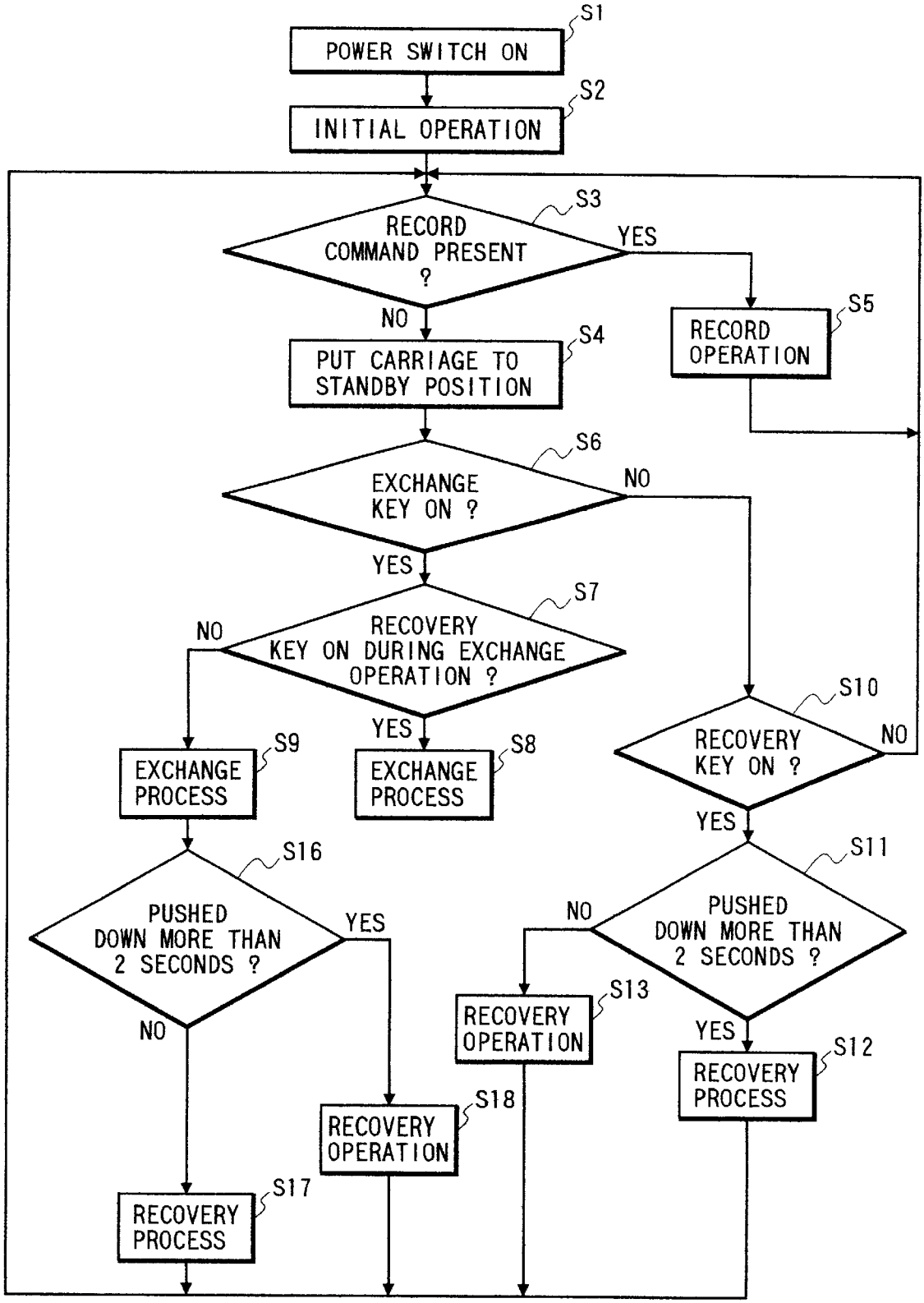
FIG. 9 is a flowchart showing the operation by means of the operational keys in accordance with an embodiment of the present invention.

FIG. 9 is a flowchart illustrating the key operations described above. The flowchart is self-explanatory, and shows one example in which the printing apparatus is controlled along the process flow described therein. With respect to the flowchart, an attention should be given to the arrangement that priority is given to the key that has been operated earlier when the power-supply is turned on. It is clear that the present invention is particularly effective in such a case.

FIG. 10 to FIG. 12B are views showing the structure of the embodiment that illustrates the identifying mechanism and guiding mechanism for ink jet printing members in accordance with the present invention.

Figure 12A:
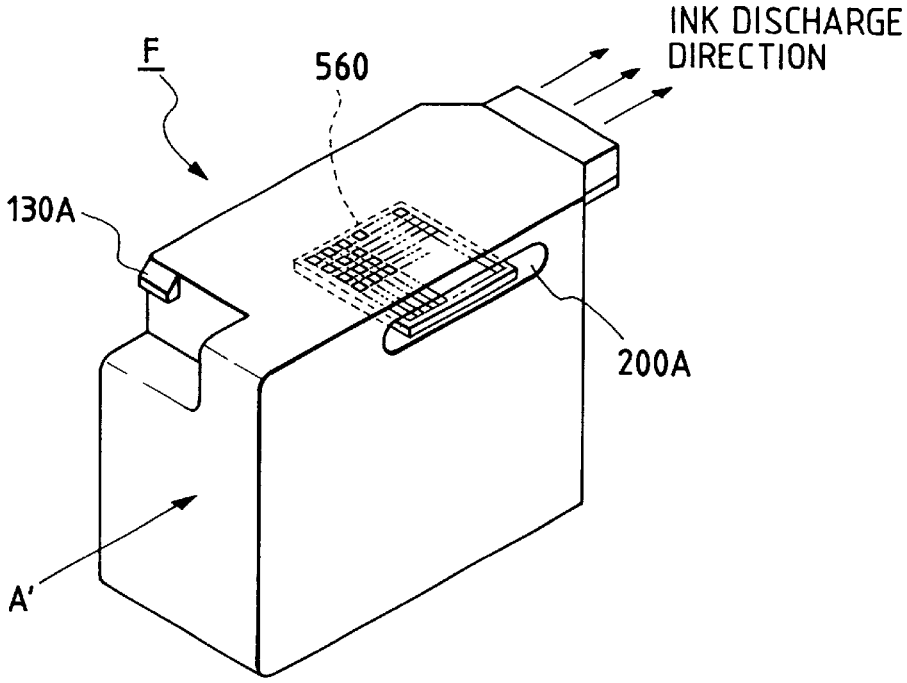
FIGS. 12A and 12B are views which illustrate the identifying mechanism and guiding mechanism for an ink jet printing member of an ink jet printing apparatus in accordance with the present embodiment.
Figure 12B:
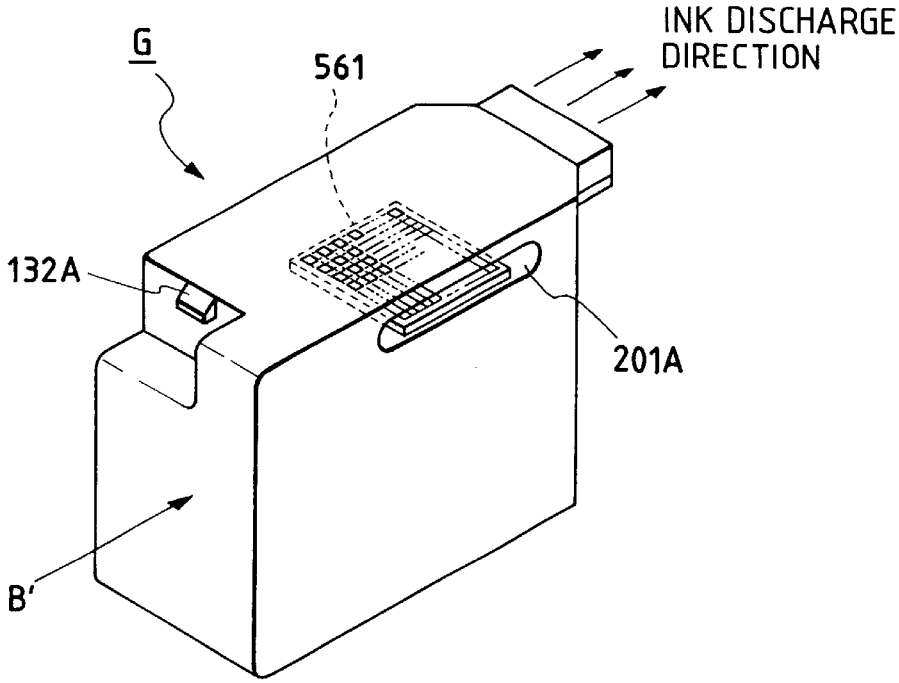

The ink jet printing members F and G shown in FIGS. 12A and 12B retain different ink tanks, and the ink jet printing member F is for use of color recording where plural ink tanks are retained for ink of different colors. The ink jet printing member G is for use of a monochromatic recording where an ink tank is retained only for ink in black color.

As described above, although the outer appearance is the same for both the ink jet printing members F and G, ink retained in them and the structures of discharge ports for discharging ink are different. An identification number is, therefore, provided for each of the ink jet printing members F and G to distinguish one kind from the other. Such number is electrically stored in storage means (not shown). Here, the general structure is to read out each of the identification numbers stored in the storage means through the electrical contact.

For the ink jet printing members F and G described above, the mounting operation is manually conducted. In this mounting operation, it is conceivable that ink adheres to the surface where the electrical contact is made if there is any error on the operator's side. In such a case, the identification cannot be executed normally. Also, such situation as described above is only recognizable after an identification is made. The situation cannot be grasped at the time of mounting the member.

The present embodiment is to simplify the structure of the apparatus, which can serve dually as the identifying mechanism and guiding mechanism for ink jet printing members, and to solve the problem described above simultaneously. The structure thereof will be described hereunder.

On each of the ink jet printing members F and G, slots 200A and 201A are formed. In each of the slots, base boards 560 and 561 are arranged to receive electric signals from the base board 56. Also, each of the ink jet printing members F and G is provided with storage means for storing each of the identification numbers to indicate its kind as described above. Then, it is arranged that such identification number is transmitted to controlling means of the recording apparatus through the base boards 560 and 561, and the base board 56, as well. The controlling means transmits the electric signals for the execution of the recording control in accordance with the identification number. In this way, discharges are performed in accordance with the kinds of the ink jet printing members F and G, respectively.

Figure 15:
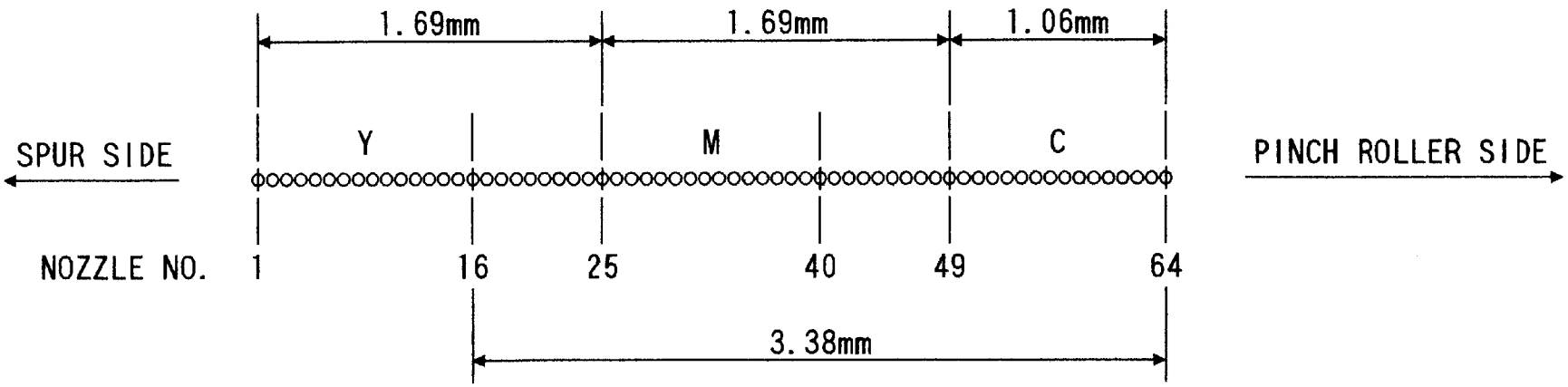
FIG. 15 is a view which shows the nozzle structure of an ink jet printing member F for color recording use.

FIG. 15 shows the nozzle structure of the ink jet printing member F for use of color recording. A plurality of nozzles (nozzle Nos. 1 to 16, 25 to 40, and 49 to 64) are arranged to discharge yellow (Y), magenta (M), and cyan (C) ink, respectively. Here, non-discharge nozzles are formed between these nozzles.

As shown in FIGS. 12A and 12B, one vertex or corner of each of the ink jet printing members F and G is cut off, respectively. For each cut-off portion, extrusions 130A and 132A are provided as identifying means because their positions are deviated from each other.

Figure 10:
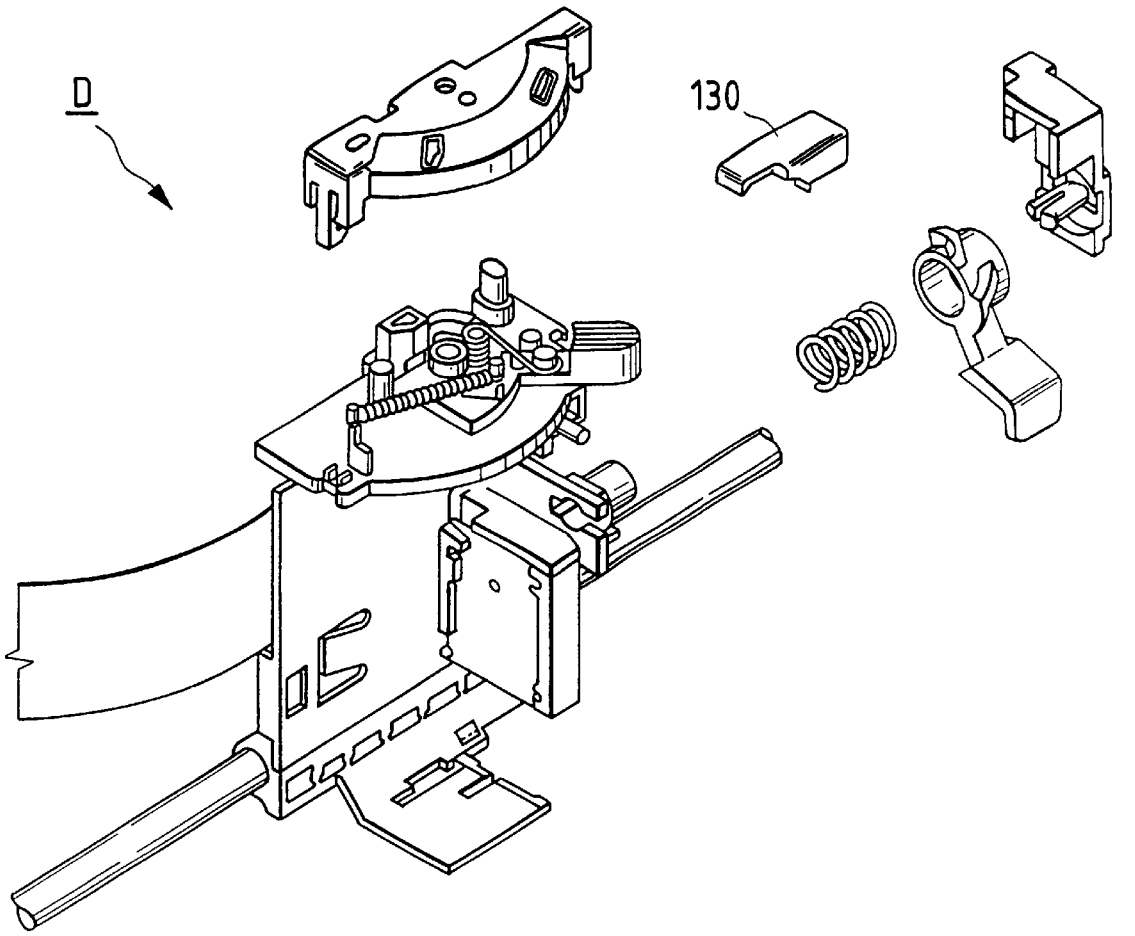
FIG. 10 is a view which illustrates the identifying mechanism and guiding mechanism for an ink jet printing member of an ink jet printing apparatus in accordance with the present embodiment.
Figure 11:
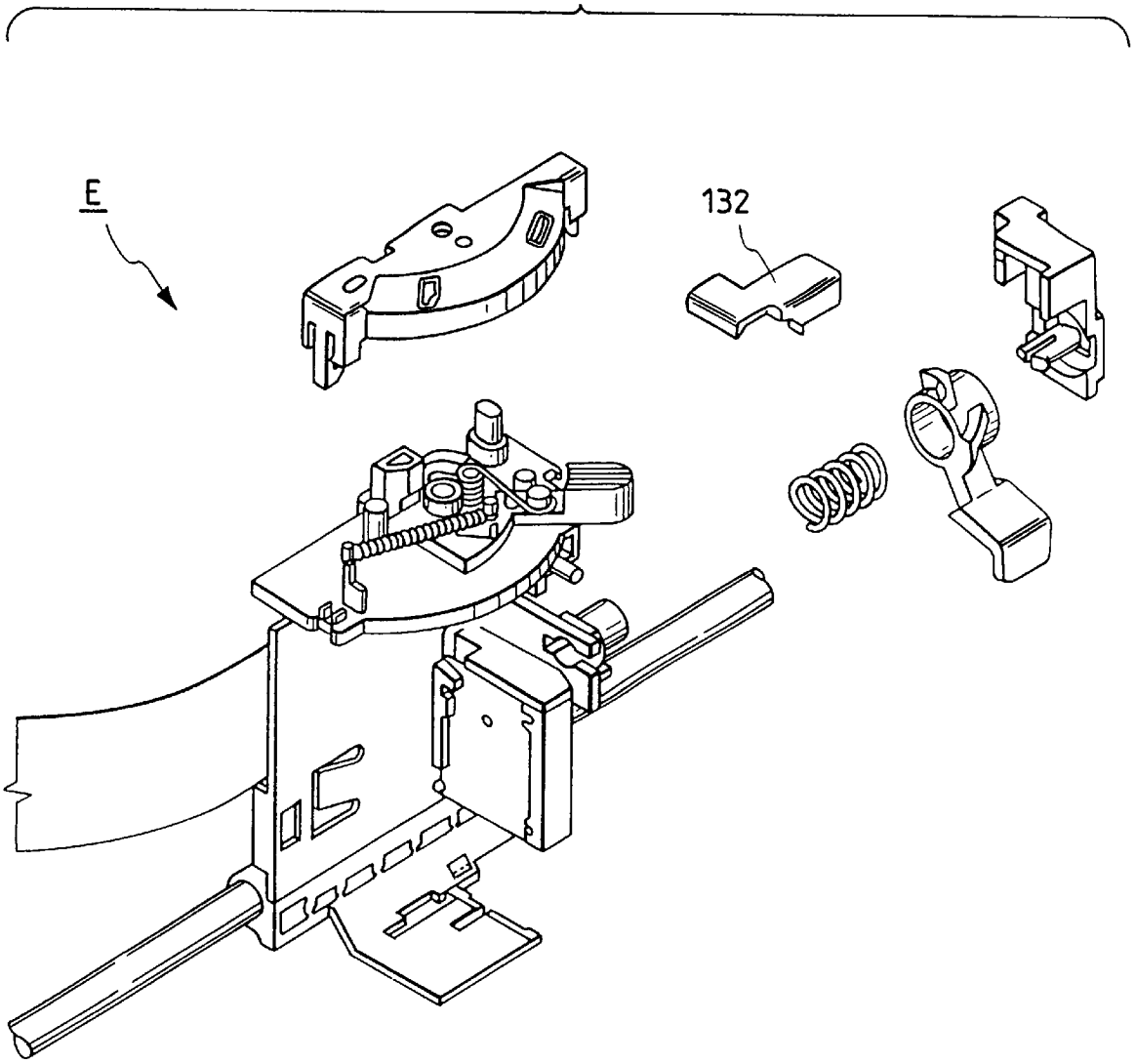
FIG. 11 is a view which illustrates the identifying mechanism and guiding mechanism for an ink jet printing member of an ink jet printing apparatus in accordance with the present embodiment.

Of the carriages D and E shown in FIG. 10 and FIG. 11, the carriage E is provided with a hook 132 that can engage with any one of extrusions 130A and 132A of the ink jet printing members F and G. The carriage D is provided with a hook 130 that can engage only with the extrusion 132A of the ink jet printing member G. In this way, with respect to the ink jet printing members F and G, the carriage D is structured to be able to mount only the ink jet printing member G on it, while the carriage E is structured to be able to mount both the ink jet printing members F and G.

Each of the ink jet printing members described above is in the mode that an ink jet head and an ink tank are integrally retained in one case. Here, however, the description will be further made of a mode that the operator can separate the ink jet head and ink tank of the ink jet printing member.

Figure 13A:
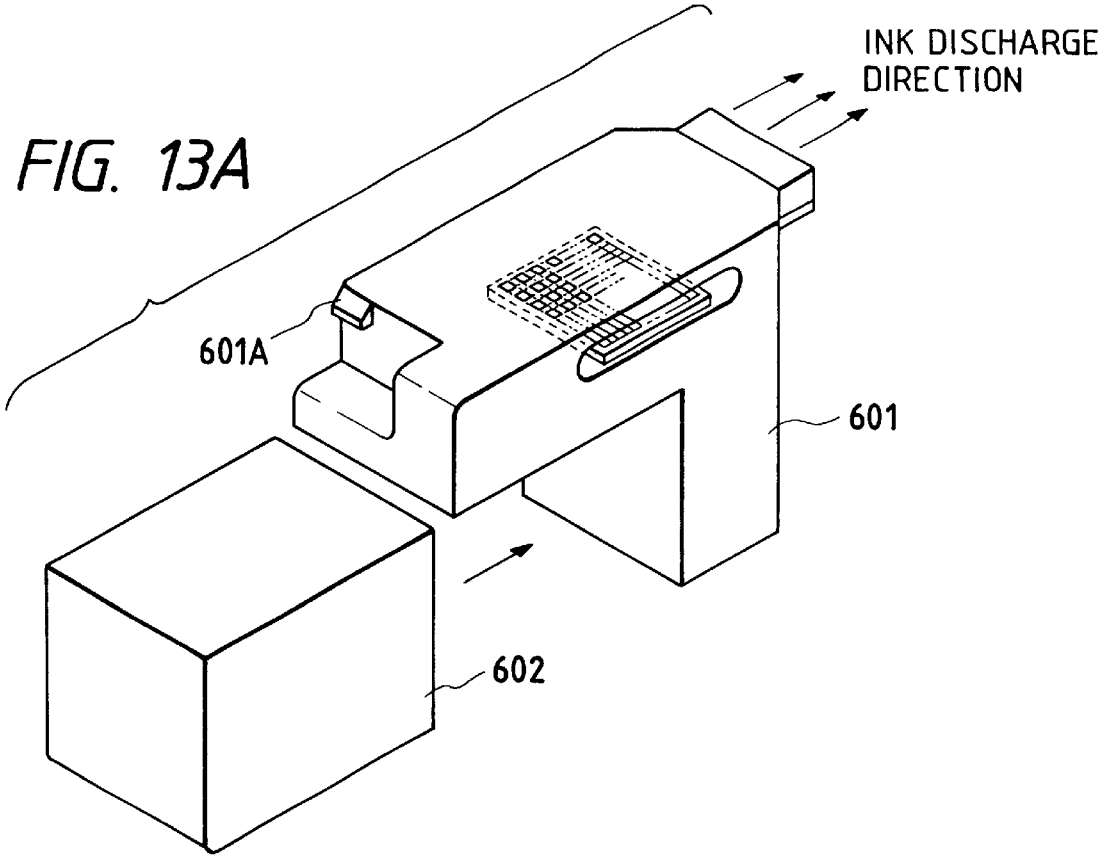
FIGS. 13A and 13B are views showing the identifying mechanism and guiding mechanism for an ink jet printing member of an ink jet printing apparatus in accordance with the present embodiment, respectively.

FIG. 13A shows a mode in which an ink jet head 601 and an ink tank 602 are individual elements, and are used after these elements are put together into one body. Here, the ink jet head 601 is provided with a member 601A corresponding to the member designated by a reference numeral 130A or 132A in FIGS. 12A and 12B. As in the mode represented in FIGS. 12A and 12B, it is possible for this mode to obtain the effect that the mounting of the head on the carriage and the identification of the kind of the head are possible simultaneously.

Figure 13B:
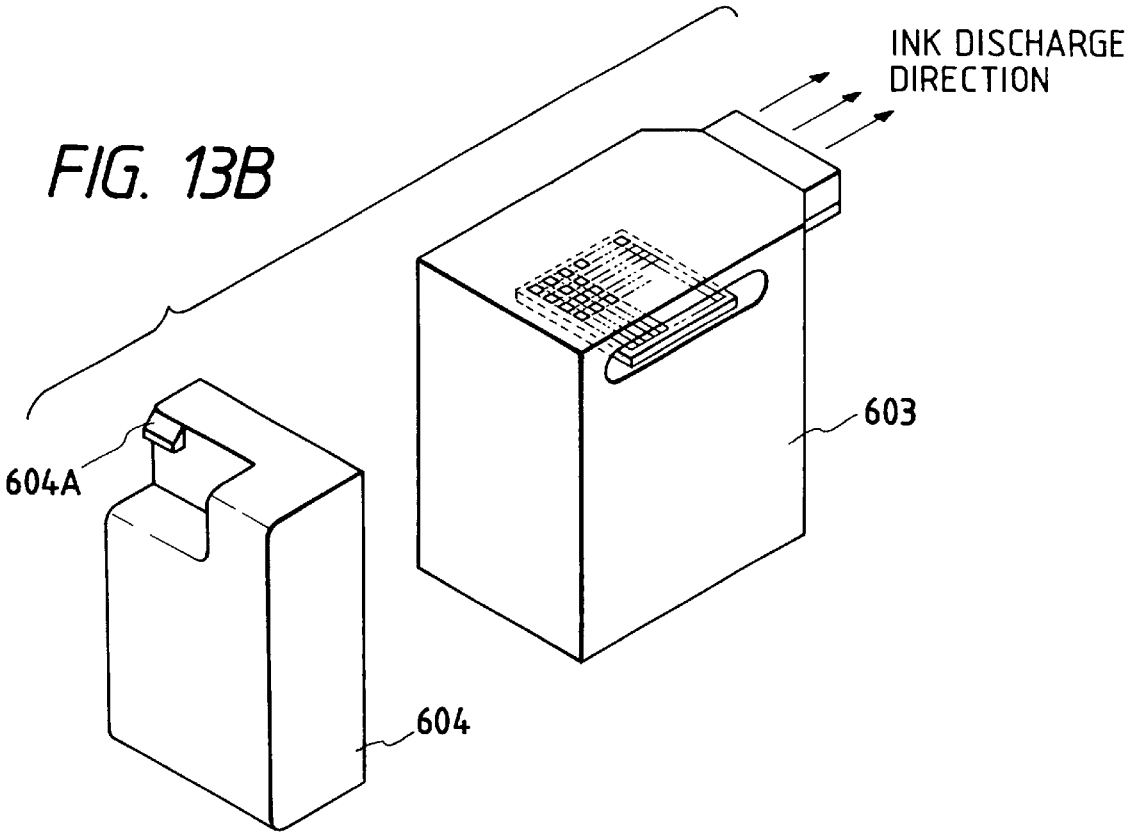

FIG. 13B shows a mode in which an ink head 603 and an ink tank 604 are individual elements, and the ink tank 604 is provided with a member 604A corresponding to the member designated by a reference numeral 130A or 132A in FIG. 12B. In this case, too, it is possible to obtain the same effect as described above.

Here, in each of the modes shown in FIGS. 13A and 13B, there is a need for the arrangement of the malfunction preventive means that admits only of a mounting having a specific relationship between an ink jet head and an ink tank if the ink jet head and ink tank are usable only with a specific combination between them or between an ink jet recording apparatus and the ink jet head and ink tank to be mounted on the apparatus.

FIGS. 14A to 14F are views showing the state of each engagement between the ink jet printing members F and G and the hooks 130 and 132, respectively, observed in the direction indicated by arrows A' and BI in FIGS. 12A and 12B.

Each of the hooks 130 and 132 is structured to protrude toward the extrusion 132A provided for the ink jet printing member G when it engages with the ink jet printing members.

Figure 14A:
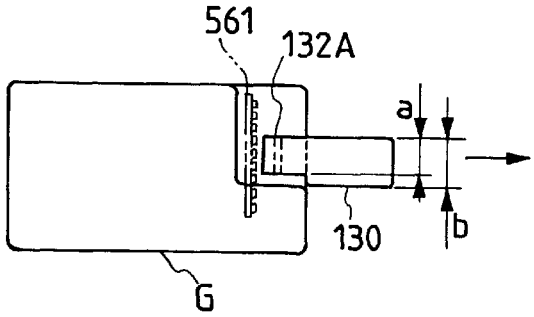
FIGS. 14A to 14F are views showing the state of engagement between the ink jet printing members F and G and the hooks 130 and 132, observed in the directions indicated by arrows A' and B' in FIGS. 12A and 12B.
Figure 14B:
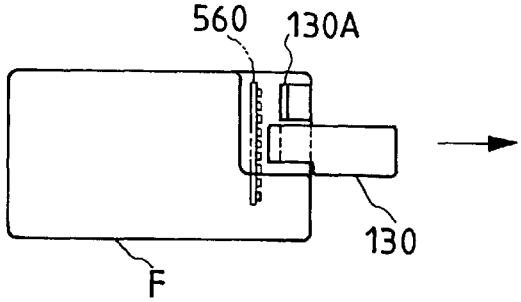
Figure 14C:
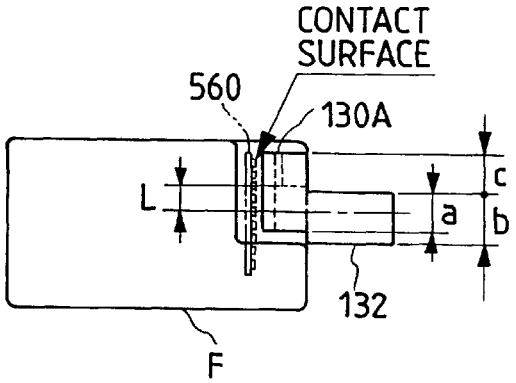

The width of the engaging portion of the hook 130 that engages only with the ink jet printing member G is made 6 mm that enables it to engage only with the extrusion 132A. Therefore, as shown in FIGS. 14A and 14B, this hook can engage with the extrusion 132A of the ink jet printing member G, but it cannot engage with the extrusion 130A of the ink jet printing member F. As a result, the carriage D can mount only the ink jet printing member G for use of monochromic recording.

The width of the engaging portion of the hook 132 that can engage with any one of the ink jet printing members F and G is extended by a width c to the extrusion 130A side from the width of the hook 130. As shown in FIGS. 14C to 14F, this hook is in the L-letter shape. In this way, the hook 132 can engage with the ink jet printing member F whose extrusion 130A is formed in a position different from that of the ink jet printing member G. Therefore, the carriage E shown in FIG. 11 can mount any one of the ink jet printing member F for use of color recording and the ink jet printing member G for use of monochromic recording.

With the engaging mechanism structured as described above, it is possible to use the hooks as engaging means in addition to the use thereof as positioning means depending on the ways of setting the dimensions for each of the hooks. Therefore, it is also possible to mount each of the ink jet printing members on the carriage in good precision.

Figure 14D:
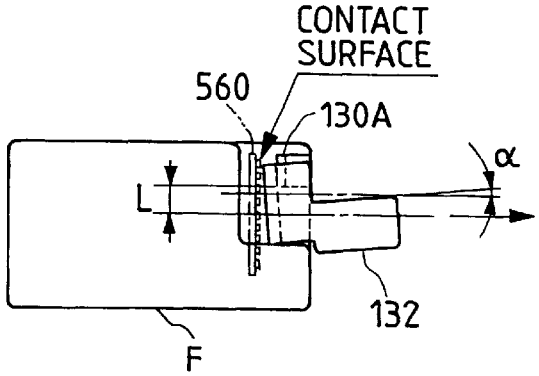
Figure 14E:
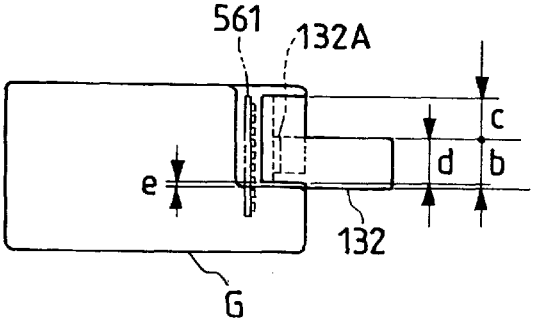
Figure 14F:
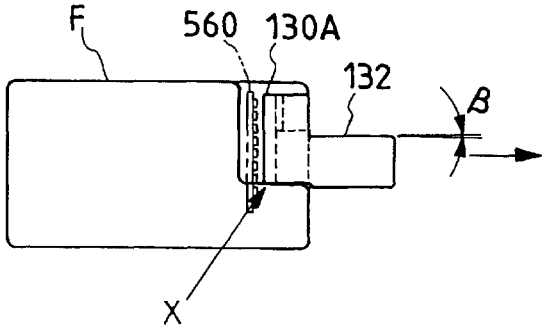

For the hook 130 shown in FIGS. 14A and 14B, the width of the engaging portion is set at a. For the hook 132 shown in FIGS. 14C and 14D, it is configured to extend by a width c on the extrusion 130A side at the time of engagement. Here, either of these hooks is arranged at a certain gap with respect to the side wall of the cut-off portion formed on either ink jet printing member F or G. Further, the pressing position with respect to the base board 560 is deviated from the center by an amount of L. Consequently, as shown in FIG. 14D, the hook 132 often engages at an angle a depending on the mounting condition (the situation is the same to the hook 130), hence making it difficult to mount either of them on the carriage in good precision. Therefore, the width of the engaging portion is set at d, which is larger than a, as shown in FIGS. 14E and 14F, thus making the gap extremely small at e with respect to the side wall portion. In this way, the inclination of the hook 132 at the time of mounting (the same to the hook 130) is corrected by the side wall of the cut-off portion as indicated by an arrow X, thus making it possible to regulate the maximum angle of deflection to be within an angle $\beta$, which is sufficiently smaller than the angle $\alpha$.

In the identifying mechanism for the ink jet printing members in accordance with the present embodiment described above, the hook 130 engages only with the ink jet printing member G for use of monochromatic recording. Therefore, when the user exchanges ink jet printing members, he can confirm that the mounted ink jet printing member is an ink jet printing member G for use of monochromatic recording at the same time that he can confirm the completion of the intended mounting. An identifying mechanism of the kind is used in parallel with the conventional identification to be executed by use of an electrical contact. Therefore, it is possible to confirm the mounted ink jet printing member more reliably.

Also, with respect to the hook 132, the description has been made of the one structured to be able to engage with either of the ink jet printing member F for use of color recording or the ink jet printing member G for use of monochromatic recording, but this description is made in assumption of a case where the ink jet recording apparatus for use of color recording is used just for recording in monochromatic color alone. For the ink jet recording apparatus which performs only color recording, but not any recording in monochromatic color alone, it is possible to arrange that such apparatus can engage only with the ink jet printing member F for use of color recording just by modifying its mode so that any mechanism to engage with an extrusion is omitted from the location where the extrusion 132A is provided for the ink jet printing member G for use of monochromatic recording. In this case, when the user exchanges ink jet printing members F, he can confirm that the mounted ink jet printing member is an ink jet printing member F for use of color recording at the same time that he can confirm the completion of the intended mounting as in the case described above.

Figure 16:
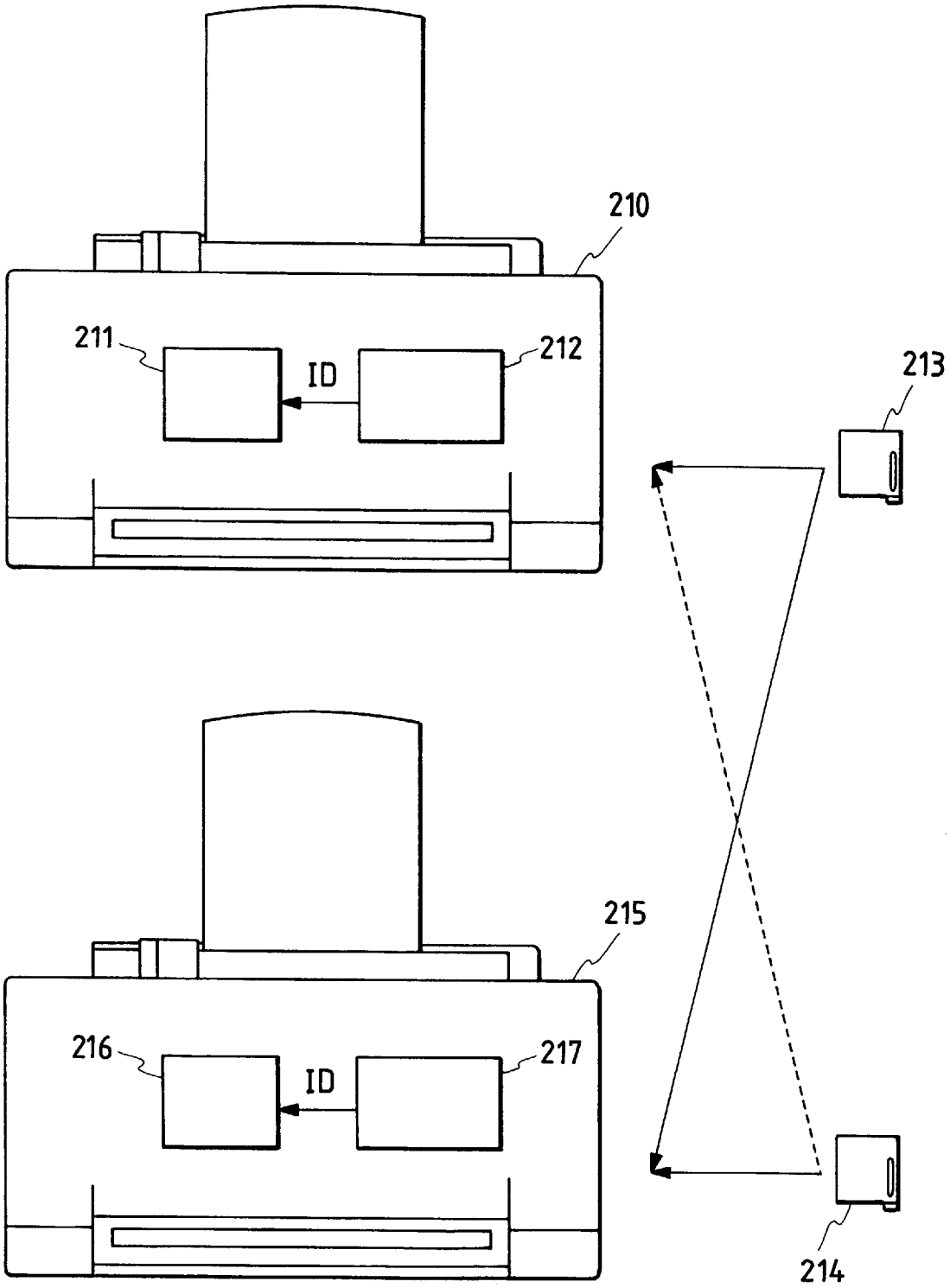
FIG. 16 is a view which shows the capability of selective mounting in accordance with the present embodiment.

FIG. 16 is a view which shows a system with two ink jet printers having the capability of selective mounting by means of structure described above.

The ink jet printing member 213 and an ink jet printer 210 are for use of monochromatic recording. The ink jet printing member 214 and an ink jet printer 215 are for use of color recording. When the ink jet printing members are mounted on the carriages 212 and 217, identification numbers (IDs) stored in them are read out by head reading means, and the kinds of the ink jet printing members are confirmed by head identifying means 211 and 216. Here, whereas the ink jet printing member 213 can be mounted on either of the ink jet printers 210 and 215, the ink jet printing member 214 is rejected to be mounted on the carriage of the ink jet printer 210, because of the arrangement of the extrusions and hooks in such a way as described above. The structure is arranged so that prior to the intended mounting, it is possible to confirm whether or not the mounting ink jet printing member is appropriate. In this respect, a solid-line arrow in FIG. 16 indicates the capability of mounting, while a broken-line arrow indicates the incapability thereof.

In the present embodiment, one example is represented, in which the confirmation of the mounted ink jet printing member is made by controlling the engaging condition with respect to the hooks depending on the positions where the extrusions are arranged. However, it may be possible to confirm the mounted ink jet printing member by controlling the engaging condition with respect to the configuration and others of the extrusions and hooks, while the extrusions are positioned in the same location.

As described above, at the time of the completion of mounting, it is confirmed which one of ink jet printing members F and G is mounted, even when the stored identification numbers cannot be read out in good condition from the storage means provided for each of the ink jet printing members F and G.

In this respect, the ink jet head uses recording means (recording head) of ink jet type that discharges ink by utilizing thermal energy, which can be fabricated easily with a highly densified liquid path arrangement (discharge port arrangement) by the formation of electrothermal transducing elements such as heaters for generating thermal energy for use of discharging ink, electrodes, walls of liquid paths, a ceiling plate, and others on a base board by the application of thin film formation technique through etching, deposition, sputtering and other semiconductor fabrication processes, hence making it possible to fabricate the head more compactly.

In accordance with the embodiment described above, the engaging means of the ink jet printing members is arranged to function dually as identifying means in order to carry out the required identification promptly and reliably, thus making it possible to avoid any erroneous mounting of the members effectively.

Also, with the provision of the engaging and identifying means as described above, there is no need for any additional provision of mechanical elements, thus making it possible to simplify the structure, and also, to implement the sharable use of components, leading to the effective reduction of the manufacturing costs.

Moreover, with the key arranged in the location where it is housed in the printing apparatus when the opening and closing member is in the closed state, and becomes operative when this member is in the open state, the carriage can travel to the exchanging area to exchange ink jet printing members or detachably mount them on the carriage. Therefore, it is possible to perform the manual operation only when the opening and closing member is in the open state. As a result, there is no possibility that any useless operation is committed untimely. It is also possible to eliminate any waste of ink and time.

What is claimed is:

1. A printing system comprising:

a first printer having first positioning means for positioning printing members, said first printer having predetermined functions;

a second printer having second positioning means for positioning printing members, said second printer having additional functions;

a first printing member of the printing members, said first printing member comprising first engaging means for engaging with said first positioning means of said first printer; and a second printing member of the printing members, said second printing member comprising second engaging means for engaging with said second positioning means of said second printer, said second engaging means being arranged in a location so as not to be engageable with said first positioning means.

2. A printing unit supply system according to claim 1, wherein said second printing member further comprises an additional part to adjust positioning of said second printing member when said second engaging means engages with said second positioning means of said second printer.

3. A printing unit supply system according to claim 1 or claim 2, wherein said second printing member comprises information indicating said second printing member being different from said first printing member, said information being capable of identifying said second printer when said second printing member is positioned by said second positioning means of said second printer.

4. A printing system according to claim 1, wherein each printing member comprises a recording head.

5. A printing system according to claim 1, wherein each printing member comprises an ink storage member.

6. A printing system according to claim 1, wherein each printing member comprises a cartridge integrally including a recording head and an ink storage member.

7. A printing system according to claim 1, wherein each printing member is provided with a recording head for discharging ink by use of thermal energy, and electrothermal energy transducing elements for generating thermal energy given to ink.

8. A printing system according to claim 1, wherein said first and second positioning means are formed in a dimensional configuration to be able to dually effect positioning and identifying at a time of mounting.

9. A printing system for use with a first printing member and a second printing member different from said first printing member, said first printing member being provided with a first engaging part and said second printing member being provided with a second engaging part, said supply system supplying:

a first printer comprising a first positioning mechanism including a first hooking unit; and a second printer comprising a second positioning mechanism including a second hooking unit having a width wider than that of said first hooking unit of said first positioning mechanism, said wider second hooking unit being arranged to engage at one time either of said first engaging part of said first printing member and said second engaging part of said second printing member.

10. A printing system according to claim 9, wherein each printing member comprises a recording head.

11. A printing system according to claim 9, wherein each printing member comprises an ink storage member.

12. A printing system according to claim 9, wherein each printing member comprises a cartridge integrally including a recording head and an ink storage member.

13. A printing system according to claim 9, wherein each printing member is provided with a recording head for discharging ink by use of thermal energy, and electrothermal energy transducing elements for generating thermal energy given to ink.

14. A printing system according to claim 9, wherein said first and second positioning mechanisms are formed in a dimensional configuration to be able to dually effect positioning and identifying at a time of mounting.

15. A printing system according to claim 9, wherein said second printing member further comprises an additional part to adjust positioning of said second printing member when said second engaging part engages with said second positioning mechanism of said second printer.

16. A printing system according to claim 9, wherein said second printing member comprises information indicating said second printing member being different from said first printing member, said information being capable of identifying said second printer when said second printing member is positioned by said second positioning mechanism of said second printer.

17. An ink jet print member mountable on both a first ink jet printer having first mounting means for mounting at one time either of said ink jet print member or a different ink jet print member, and a second ink jet printer having second mounting means for mounting said ink jet print member but not the different ink jet print member mountable on the first ink jet printer, said ink jet print member comprising:

an engaging section being engageable with both the first mounting means and the second mounting means, said engaging section being different from a corresponding engaging section located on the different ink jet print member, the corresponding engaging section being engageable with the first mounting means.

18. An ink jet print member according to claim 17, wherein said member comprises a recording head for discharging ink by use of thermal energy, said recording head comprising electrothermal energy transducing elements for generating the thermal energy to be applied to the ink.

19. A printing unit supply system using said ink jet print member according to claim 17 or claim 2.

20. A printing unit supply system according to claim 19, wherein said engaging section is formed in a dimensional configuration to be able to dually perform positioning and identifying at the time of mounting.

21. An ink jet print member according to claim 17 or claim 18 wherein said engaging section is formed in a dimensional configuration to be able to dually effect positioning and identifying at a time of mounting.

22. An ink jet print member according to claim 17, wherein said print member comprises a recording head.

23. An ink jet print member according to claim 17, wherein said print member comprises an ink storage member.

24. An ink jet print member according to claim 17, wherein said print member comprises a cartridge integrally including a recording head and an ink storage member.

25. An ink jet print member according to claim 17, further comprising an additional part to adjust positioning of said print member when said engaging section engages with said second mounting means of said second ink jet printer.

26. An ink jet print member according to claim 17, further comprising information indicating said ink jet print member being different from said different ink jet print member, said information being capable of identifying said second ink jet printer when said ink jet print member is positioned by said second mounting means of said second ink jet printer.

27. An ink jet printing system for use with a monochrome print member having a first engaging section and a color print member having a second engaging section, said system comprising:

a monochrome printer for printing monochrome images, said monochrome printer comprising a first positioning mechanism engageable with only the first engaging section of the monochrome print member; and a color printer for printing monochrome or color images, said color printer comprising a second positioning mechanism engageable at one time with either of the first engaging section of the monochrome print member and the second engaging section of the color print member.

28. An ink jet printing system according to claim 27, wherein each print member comprises a recording head for discharging ink by use of thermal energy, each recording head comprising electrothermal energy transducing elements for generating the thermal energy to be applied to the ink.

29. An ink jet printing system according to claim 27, wherein each print member comprises a recording head.

30. An ink jet printing system according to claim 27, wherein each print member comprises an ink storage member.

31. An ink jet printing system according to claim 27, wherein each print member comprises a cartridge integrally including a recording head and an ink storage member.

32. An ink jet printing system according to claim 27, wherein said first and second engaging sections are formed to be in a dimensional configuration to be able to dually effect positioning and identifying at a time of mounting.

33. An ink jet printing system according to claim 27, wherein said color print member further comprises an additional part to adjust positioning of said color print member when said second engaging section engages with said second positioning mechanism of said color printer.

34. An ink jet printing system according to claim 27, wherein said color print member comprises information indicating said color print member being different from said monochrome print member, said information being capable of identifying said color printer when said color print member is positioned by said second positioning mechanism of said color printer.

35. A printing member supplying method comprising the steps of:

providing a first printer having first positioning means for positioning printing members, the first printer having predetermined functions, and a second printer having second positioning means for positioning printing members, the second printer having additional functions;

supplying a first printing member of the printing members, the first printing member comprising first engaging means for engaging with the first positioning means of the first printer; and supplying a second printing member of the printing members, the second printing member comprising second engaging means for engaging with the second positioning means of the second printer, the second engaging means being arranged in a location so as not to be engageable with the first positioning means.

36. A printing member supplying method according to claim 35, wherein each printing member comprises a recording head.

37. A printing member supplying method according to claim 35, wherein each printing member comprises an ink storage member.

38. A printing member supplying method according to claim 35, wherein each printing member comprises a cartridge integrally including a recording head and an ink storage member.

39. A printing member supplying method according to claim 35, wherein each printing member is provided with a recording head for discharging ink by use of thermal energy, and electrothermal energy transducing elements for generating thermal energy given to ink.

40. A printing member supplying method according to claim 35, wherein each engaging means is formed in a dimensional configuration to be able to dually effect positioning and identifying at a time of mounting.

41. A printing member supplying method according to claim 35, wherein said second printing member further comprises an additional part to adjust positioning of said second printing member when said second engaging means engages with said second positioning means of said second printer.

42. A printing member supplying method according to claim 35, wherein said second printing member comprises information indicating said second printing member being different from said first printing member, said information being capable of identifying said second printer when said second printing member is positioned by said second positioning means of said second printer.

43. A print member mountable on both a first printer having first mounting means for mounting at one time either of said print member or a different print member, and a second printer having second mounting means for mounting said print member but not the different print member mountable on the first printer, said print member comprising:

an engaging section being engageable with both the first mounting means and the second mounting means, said engaging section being different from a corresponding engaging section located on the different print member, the corresponding engaging section being engageable with the first mounting means.

44. A print member according to claim 43, wherein said print member comprises a recording head for discharging ink by use of thermal energy, and electrothermal energy transducing elements for generating thermal energy given to ink.

45. A print member according to claim 43, wherein said engaging section is formed in a dimensional configuration to be able to dually effect positioning and identifying at a time of mounting.

46. A print member according to claim 43, further comprising an additional part to adjust positioning of said print member when said engaging section engages with said second mounting means of said second printer.

47. A print member according to claim 43, further comprising information indicating said print member being different from said different print member, said information being capable of identifying said second printer when said printing member is positioned by said second mounting means of said second printer.

48. A print member according to claim 43, wherein said print member comprises a recording head.

49. A print member according to claim 43, wherein said print member comprises an ink storage member.

50. A print member according to claim 43, wherein said print member comprises a cartridge integrally including a recording head and an ink storage member.

51. A printing system for use with a monochrome print member having a first engaging section and a color print member having a second engaging section, said system comprising:

a monochrome printer for printing monochrome images, said monochrome printer comprising a first positioning mechanism engageable with only the first engaging section of the monochrome print member; and a color printer for printing monochrome or color images, said color printer comprising a second positioning mechanism engageable at one time with either of the first engaging section of the monochrome print member and the second engaging section of the color print member.

52. A printing system according to claim 51, wherein each print member comprises a recording head.

53. A printing system according to claim 51, wherein each print member comprises an ink storage member.

54. A printing system according to claim 51, wherein each print member comprises a cartridge integrally including a recording head and an ink storage member.

55. A printing system according to claim 51, wherein each print member is provided with a recording head for discharging ink by use of thermal energy, and electrothermal energy transducing elements for generating thermal energy given to ink.

56. A printing system according to claim 51, wherein the first and second engaging sections are formed in a dimensional configuration to be able to dually effect positioning and identifying at a time of mounting.

57. A printing system according to claim 51, wherein said color print member further comprises an additional part to adjust positioning of said color print member when said second engaging section engages with said second positioning mechanism of said color printer.

58. A printing system according to claim 51, wherein said color print member comprises information indicating said color print member being different from said monochrome print member, said information being capable of identifying said color printer when said color print member is positioned by said second positioning mechanism of said color printer.

59. A printing unit supply system comprising:

a print member mountable on both a first printer having first mounting means for mounting at one time either of said print member or a different print member, and a second printer having second mounting means for mounting said print member but not the different print member mountable on the first printer, said print member comprising an engaging section being engageable with both the first mounting means and the second mounting means, said engaging section being different from a corresponding engaging section located on the different print member, the corresponding engaging section being engageable with the first mounting means.

60. A system according to claim 59, wherein said print member comprises a recording head for discharging ink by use of thermal energy, and electrothermal energy transducing elements for generating thermal energy given to ink.

61. A system according to claim 59, wherein said engaging section is formed in a dimensional configuration to be able to dually effect positioning and identifying at a time of mounting.

62. A system according to claim 59, further comprising an additional part to adjust positioning of said print member when said engaging section engages with said second mounting means of said second printer.

63. A system according to claim 59, further comprising information indicating said print member being different from said different print member, said information being capable of identifying said second printer when said printing member is positioned by said second mounting means of said second printer.

64. A system according to claim 59, wherein said print member comprises a recording head.

65. A system according to claim 59, wherein said print member comprises an ink storage member.

66. A system according to claim 59, wherein said print member comprises a cartridge integrally including a recording head and an ink storage member.

67. A print member mountable on a first printer having first mounting means for mounting at one time either of said print member or a different print member but not mountable on a second printer having second mounting means for mounting the different print member mountable on the first printer but not said print member, said print member comprising:

an engaging section engageable with the first mounting means but not engageable with the second mounting means, said engaging section being different from a corresponding engaging section located on the different print member and the corresponding engaging section being engageable with the first mounting means and the second mounting means.

68. A print member according to claim 67, wherein said print member comprises a recording head.

69. A print member according to claim 67, wherein said print member comprises an ink storage member.

70. A print member according to claim 67, wherein said print member comprises a cartridge integrally including a recording head and an ink storage member.

71. A print member according to claim 67 wherein said print member comprises an ink jet recording head for discharging ink to record.

72. A printing unit supply system comprising:

a print member mountable on a first printer having first mounting means for mounting at one time either of said print member or a different print member but not mountable on a second printer having second mounting means for mounting the different print member mountable on the first printer but not said print member, said print member comprising an engaging section engageable with the first mounting means but not engageable with the second mounting means, said engaging section being different from a corresponding engaging section located on the different print member and the corresponding engaging section being engageable with the first mounting means and the second mounting means.

73. A system according to claim 72, wherein said print member comprises a recording head.

74. A system according to claim 72, wherein said print member comprises an ink storage member.

75. A system according to claim 72, wherein said print member comprises a cartridge integrally including a recording head and an ink storage member.

76. A system according to claim 72, wherein said print member comprises an ink jet recording head for discharging ink to record.

77. A printer for mounting at one time either of a first print member or a second print member, the second print member also being mountable on a different printer, said printer comprising:

an engaging section engageable with both the first print member and the second print member, said engaging section being different from a corresponding engaging section located on the different printer and the corresponding engaging section being engageable with the second print member but not engageable with the first print member.

78. A printer according to claim 77, wherein the first and second print members comprise recording heads.

79. A printer according to claim 77, wherein the first and second print members comprise ink storing members.

80. A printer according to claim 77, wherein the first and second print members comprise cartridges each integrally comprising a recording head and an ink storing member.

81. A printer according to claim 77, wherein the first and second print members comprise ink jet recording heads for discharging ink to record.

* * * * *

UNITED STATES PATENT AND TRADEMARK OFFICE

CERTIFICATE OF CORRECTION

PATENT NO. : 6,260,950 B1
DATED : July 17, 2001
INVENTOR(S) : Tanno et al.

It is certified that error appears in the above-identified patent and that said Letters Patent is hereby corrected as shown below:

Column 1,
Line 66, "such" should read -- such a --.

Column 7,
Line 13, "the-carrier" should read -- the carrier --.
Line 37, "designating" should be deleted.
Line 59, "location away" should read -- location --.

Column 9,
Line 35, "an" should be deleted.
Line 37, "power-supply" should read -- power supply --.

Column 11,
Line 9, "B1" should be -- B' --.

Column 15,
Line 10, "claim 2." should read -- claim 18. --.

Column 18,
Line 65, "claim 67" should read -- claim 67, --.

Signed and Sealed this

Twenty-third Day of April, 2002

*Attest:*

*Attesting Officer*

JAMES E. ROGAN
*Director of the United States Patent and Trademark Office*